US009878883B2

(12) United States Patent
Nelson

(10) Patent No.: US 9,878,883 B2
(45) Date of Patent: Jan. 30, 2018

(54) MOVING WALKWAY SAFETY SYSTEM

(71) Applicant: Kerrett Electronic Services Ltd., New Road Gravesend Kent (GB)

(72) Inventor: Stephen Nelson, Hoo Rochester Kent (GB)

(73) Assignee: KERRETT ELECTRONIC SERVICES LTD., New Road Gravesend Kent (GB)

( * ) Notice: Subject to any disclaimer, the term of this patent is extended or adjusted under 35 U.S.C. 154(b) by 0 days.

(21) Appl. No.: 15/313,190

(22) PCT Filed: May 21, 2015

(86) PCT No.: PCT/GB2015/051499
§ 371 (c)(1),
(2) Date: Nov. 22, 2016

(87) PCT Pub. No.: WO2015/177560
PCT Pub. Date: Nov. 26, 2015

(65) Prior Publication Data

US 2017/0190548 A1 Jul. 6, 2017

(30) Foreign Application Priority Data

May 23, 2014 (GB) ..... 1409235.7

(51) Int. Cl.
*B66B 25/00* (2006.01)
*B66B 29/00* (2006.01)

(52) U.S. Cl.
CPC ..... *B66B 29/00* (2013.01); *B66B 25/006* (2013.01)

(58) Field of Classification Search
CPC ..... B66B 29/00; B66B 25/00; B66B 25/006
(Continued)

(56) References Cited

U.S. PATENT DOCUMENTS 4,631,467 A * 12/1986 Herrmann ..... B66B 25/00 198/330
5,316,121 A * 5/1994 Zaharia ..... B66B 29/005 198/323

(Continued)

FOREIGN PATENT DOCUMENTS

JP H07257866 A 10/1995

OTHER PUBLICATIONS

International Search Report dated Aug. 28, 2015, PCT Application No. PCT/GB2015/051499.

(Continued)

*Primary Examiner* — James R Bidwell
(74) *Attorney, Agent, or Firm* — Blakely Sokoloff Taylor & Zafman LLP

(57) ABSTRACT

A safety system for a moving walkway having a continuous loop of steps driven by a drive system and missing step detector adapted to detect a missing step from the loop of steps. The safety system comprises: an interrupt unit adapted to control the drive system to disable automatic movement of the loop of steps upon detection of a predetermined event and adapted to subsequently control the drive system to enable automatic movement of the loop of steps only after a safety procedure has been completed without a missing step being detected by the missing step detector. The safety procedure comprises causing a step to traverse an entire loop under manual control of the drive system.

16 Claims, 1 Drawing Sheet

(58) Field of Classification Search
USPC ..... 198/323
See application file for complete search history.

(56) References Cited

U.S. PATENT DOCUMENTS

| | | | | |
|---|---|---|---|---|
| 6,112,166 | A * | 8/2000 | Joosten | B66B 27/00 198/323 |
| 8,997,968 | B2 * | 4/2015 | Braasch | B66B 29/005 198/322 |
| 2003/0168311 | A1 * | 9/2003 | Balzer-Apke | B66B 29/005 198/323 |
| 2008/0041692 | A1 * | 2/2008 | Boom | B66B 25/00 198/323 |
| 2011/0011700 | A1 * | 1/2011 | Plathin | B66B 29/005 198/323 |
| 2011/0031090 | A1 | 2/2011 | Nagao | |
| 2012/0103756 | A1 * | 5/2012 | Braasch | B66B 25/003 198/323 |

OTHER PUBLICATIONS

International Preliminary Report on Patentability, dated Nov. 29, 2016, PCT Application No. PCT/GB2015/051499.

* cited by examiner

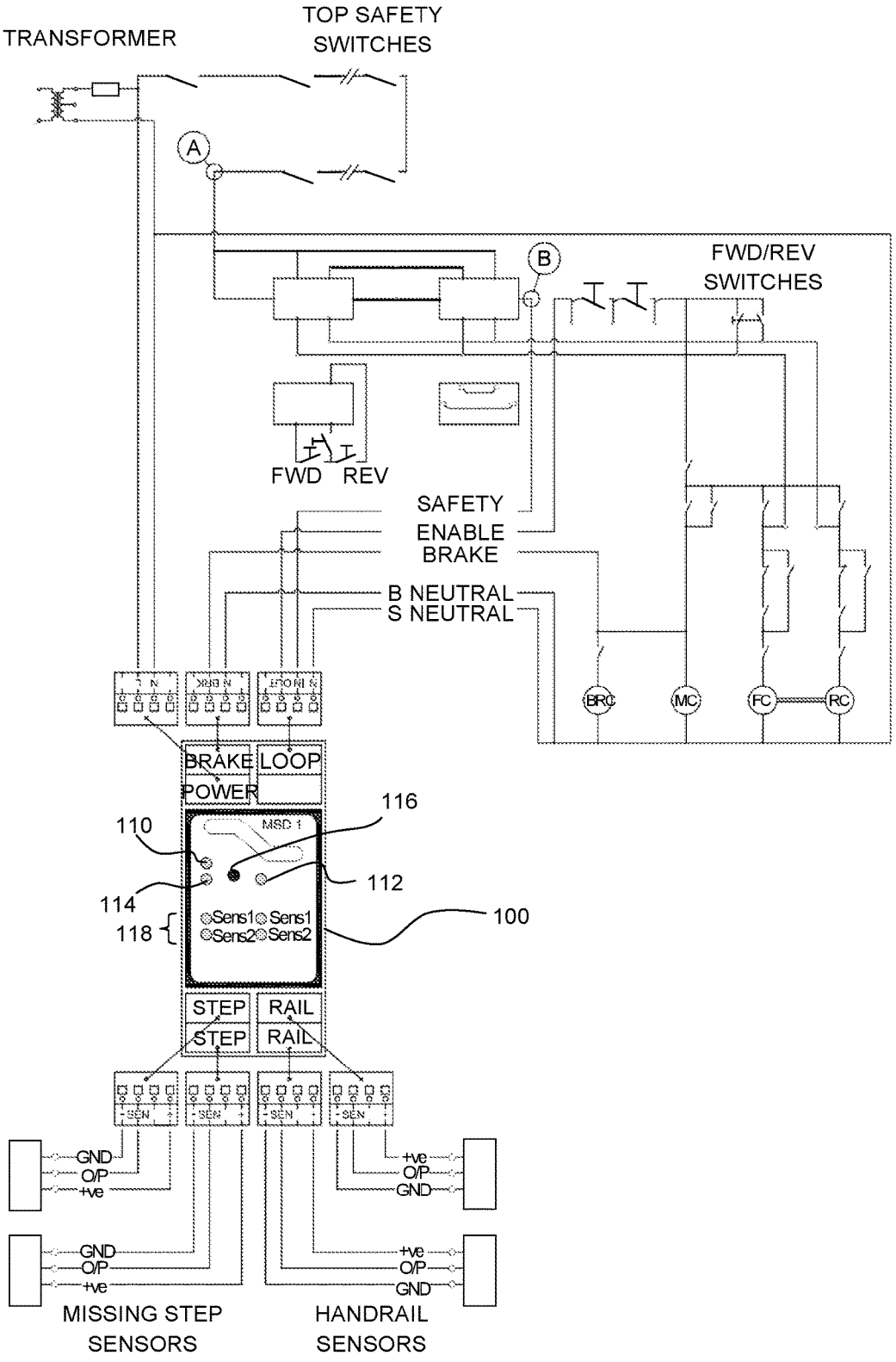
TRANSFORMER
TOP SAFETY SWITCHES
A
B
FWD/REV SWITCHES
FWD
REV
SAFETY
ENABLE
BRAKE
B NEUTRAL
S NEUTRAL
BRC
MC
FC
RC
BRAKE POWER
LOOP
MSD 1
110
116
112
114
118
100
Sens1
Sens1
Sens2
Sens2
STEP
STEP
RAIL
RAIL
SEN
GND
O/P
+ve
MISSING STEP SENSORS
HANDRAIL SENSORS

MOVING WALKWAY SAFETY SYSTEM

FIELD OF THE INVENTION

The invention relates to the field of moving walkway safety system which is adapted to be used with a moving walkway having a drive system and a missing step detector.

BACKGROUND OF THE INVENTION

Moving walkways are a commonplace feature used in many buildings. Conventional moving walkways are typically used for conveying people from a first location to a second location, for example as escalators in shopping centres/malls or as travelators in airports.

Moving walkway systems include a continuous looping stairway (e.g. in escalators) or walkway (e.g. in travelators). These have been developed to transport persons in a fast and efficient way across a relatively short distance and are often found in buildings and venues to provide a fast-throughput alternative to lifts, stairs or walking.

An example of a conventional moving walkway system is an escalator. An escalator typically functions by driving a number of adjacent steps around a continuous loop. Each step is secured at its base to a chain or multiple chains, which form the continuous loop. The chains are wrapped around gears sprockets located at the two ends of the escalator. The gears sprockets are driven by a motor, which causes the chains to rotate about the gears sprockets and the steps to traverse the loop. There may also be a moving handrail mechanically associated with the gears. Systems such as these are commonly found in underground or subway systems and allow a person or material to be traversed both horizontally and vertically.

A travelator functions in a similar fashion to an escalator but generally without the vertical displacement. In this case, the gears and the steps are configured to provide a horizontal displacement.

Conventional moving walkways often utilise complex control and monitoring systems. These are included to help reduce damage and costs that would result from any failure of the conveyor or motor and to reduce the risk of danger to the persons they are conveying. These systems therefore cannot easily be modified and the removal or alteration of these systems can render the walkway unsafe and cause the operator problems with maintenance, liability and insurance and be a difficult and expensive process.

The loop of steps that makes up part of a moving walkway can, under certain circumstances, fail by virtue of one or more steps falling from the transporting mechanism—typically a chain. Other situations may arise where one or more steps have to be replaced due to normal wear and tear.

Monitoring devices are available that are able to detect missing steps in moving walkways. These typically detect the small gaps that exist between steps. When a larger than normal gap is detected, the moving walkway is halted. This condition is typically reset by pressing a button to reset the monitoring device and subsequently re-enable automatic operation of the moving walkway.

SUMMARY OF THE INVENTION

According to the invention, there is provided an apparatus and method as defined in the independent claims.

A first aspect of the invention provides a safety system for a moving walkway having a continuous loop of steps driven by a drive system and missing step detector adapted to detect a missing step from the loop of steps, wherein the safety system comprises: an interrupt unit adapted to control the drive system to disable automatic movement of the loop of steps upon detection of a predetermined event and adapted to subsequently control the drive system to enable automatic movement of the loop of steps only after a safety procedure has been completed without a missing step being detected by the missing step detector, wherein the safety procedure comprises causing a step to traverse an entire loop under manual control of the drive system.

When a moving walkway is being serviced, sections of the chain with missing steps may be anywhere along the chain loop. So that one or more steps may be removed for repair or replacement, the chain may be moved around the loop using manual 'jog' switches to access the desired step(s). Missing step positions may therefore be hidden behind various parts of the machine and thus not visible to the servicing engineer. With conventional moving walkways, it is possible therefore, for the servicing engineer to restart automatic operation of a moving walkway with a missing step.

Embodiments may prevent automatic operation of a moving walkway until the entire loop of steps has been checked for missing steps. Thus, embodiments may provide a safety system that may be used to prevent automatic operation of a moving walkway until a check of the entire loop of steps has been completed without a missing step being detected.

A moving walkway is a system for conveying persons from a first position to a second position using a continuous loop of steps. In particular, a moving walkway may comprise an escalator or a travelator.

Embodiments may provide a safety system for connection to a conventional moving walkway that prevents automatic operation of the moving walkway until the entire loop of steps has been checked for missing steps (and no missing steps have been detected during the check). Such a system may help to ensure that an engineer is present to observe a complete loop of the steps and that automatic operation is disabled until the full loop of steps is confirmed to be present and correct. If a missing step is detected during the check of the loop (otherwise referred to as the safety procedure), the safety system will continue to disable automatic operation of the moving walkway (i.e. automatic movement of the loop of steps), and thus prevent the moving walkway from being re-started with a missing step.

The predetermined event which is detected and causes the interrupt unit to disable automatic movement of the loop of steps may be an event which gives reason for the preference or need to inspect the walkway system and check for any missing steps. The occurrence of some events may therefore not cause the interrupt unit to disable automatic operation of the walkway system, whereas other events (or sequence thereof) may be deemed of suitable importance to interrupt unit to disable automatic operation of the walkway systems. Embodiments may therefore be adapted to cater for the predetermined event(s) to be defined, altered and/or removed according to safety requirements, for example. The predetermined event may comprise at least one of: the missing step detector detecting a missing step from the loop of steps; an engineer accessing the moving walkway for maintenance or repair purposes; activation of an emergency stop control of the moving walkway; activation of a reset control of the moving walkway; and manual control of the drive system.

Embodiments may be retrospectively connected to a moving walkway, for example as an additional switch unit in the safety loop.

An embodiment may enable the straightforward and easy installation of the safety system into an existing moving walkway. As an embodiment may be simply mounted in a control cabinet of an existing moving walkway and connected to various available signals, and thus may not need to be installed in the motor control unit nor require modification of the motor control unit. Embodiments may also be fitted to an existing moving walkway system without having to disable or override pre-existing safety features.

In another embodiment, the safety system may be adapted to be retrospectively connected to a conventional moving walkway system. As the control device is adapted to intercept step detector/sensor signals, it can be located between the control panel of the moving walkway system, and step sensor(s). This may enable the safety system to easily be installed without modifying the control panel of a conventional walkway system. As it is adapted to be retrospectively fitted, the safety system can easily be inserted at this point. By enabling the safety system to be retrospectively installed, existing moving walkway systems can be updated without the significant expenditure required for a new moving walkway installation or without the major rework to the control panel and disabling of the safety systems associated with existing retrofit devices.

In a second aspect of the invention, there is provided a method of controlling a moving walkway having a continuous loop of steps driven by a drive system and missing step detector adapted to detect a missing step from the loop of steps, wherein method comprises: controlling the drive system to disable automatic movement of the loop of steps upon detection of a predetermined event; causing a step to traverse an entire loop under manual control of the drive system; and subsequently controlling the drive system to enable automatic movement of the loop of steps only if the preceding action of causing a step to traverse an entire loop under manual control of the drive system was completed without a missing step being detected by the missing step detector.

BRIEF DESCRIPTION OF THE DRAWINGS

Specific embodiments of the invention will now be discussed in detail with reference to the accompanying drawings, in which:

FIG. 1 depicts a schematic circuit diagram of an embodiment of the present invention.

DETAILED DESCRIPTION

According to a first embodiment, a safety system is provided for installation into a motorised moving walkway system. The motorised moving walkway system has a motor, which directly or indirectly drives a walkway. The motor is controlled by a motor control unit, which provides a motor control signal to the drive motor, indicating the speed and direction of the motor. The safety device is installed into the moving walkway system between the motor control unit and the motor, typically as an additional switch in the safety loop. The safety system comprises an interrupt unit which is able to intercept the motor control signal from the motor control unit and modify the signal or output a different motor control signal so that the motor operates differently compared to the operation of the motor under the unmodified motor control signal. By way of example, the interrupt unit may output a motor control signal which switches off the motor.

The interrupt unit is adapted to disable automatic operation of the drive motor upon detection of a predetermined event. The interrupt unit is also adapted to subsequently enable automatic movement of the drive motor only after a safety procedure to check the entire loop of step has been completed without a missing step being detected. In other words, the interrupt unit only re-enables automatic operation of the drive motor once the loop of steps has been manually driven around an entire loop (e.g. wherein a step is manually driven so as to traverse at least one loop) without a missing step being identified.

For this first embodiment, the predetermined event may comprise the occurrence of at least one of the following two situations: (i) a missing step being detected; or (ii) an engineer accessing the system (for the purpose of maintenance for example). It will be appreciated, of course, that the second situation may be linked to the first situation, although at other times it may not be.

The occurrence of either of the two situations above is detected by the safety system and the interrupt unit of the safety system than disables automatic operation (via the safety loop of the moving walkway system). The interrupt unit maintains this disabled status until an engineer has manually has run the walkway for a full loop without any missing steps being detected. Such manual driving and inspection of entire loop of steps may be understood to be a safety/checking procedure, and the interrupt unit only removes the disabled status once it has determined (e.g. detected) that this safety/checking procedure has been successfully completed with no missing steps being found/identified.

The safety/checking procedure may be undertaken by pressing an engineering reset button. The safety system then waits for the chain to start. This might typically be indicated by monitoring the motor brake lift. Given that the automatic safety loop has been disabled, the only way this can happen is if an engineer uses manual jog controls to force operation of the drive motor. When the brake is lifted and the chain is moving, the device monitors a pre-determined number of steps (greater than or equal to the number of steps in the entire loop) to check for any missing steps. Only after detecting the pre-determined number of steps and verifying there are no missing steps will the lock-out be cleared and automatic operation re-enabled by the interrupt unit. This procedure ensures that the engineer is present during a complete loop of the chain and that automatic operation is disabled until all of the steps in the loop are present and correct.

Irrespective of how the missing step is detected, this safety system detects either the occurrence of a detected missing step or engineer intervention and then locks out automatic operation of the moving walkway until the loop of steps has been manually run forwards (or backwards) for a pre-determined number of steps (greater than or equal to the number of steps in the entire loop) and all steps are confirmed to be present (e.g. no missing steps are detected).

Referring now to FIG. 1, on all conventional escalator systems, there are a series of safety switches monitoring such things as fire detectors, emergency stop, 'mechanical defect switches' and so on. These are always enabled as these problems can be identified and rectified without operating or dismantling the machine. The end of these sensors is indicated on the drawing as point 'A' in FIG. 1.

Following this, there is a set of sockets where an engineer can plug in remote jog switches to 'jog' the machine round to allow access and inspection. After these sockets, indicated as point 'B' in FIG. 1, other interlocks such as missing step will follow. These sockets allow the remote switches to bypass any further safety interlock switches.

The safety system is adapted to monitor the safety interlock loop downstream of the remote sockets and is therefore able to determine that the shorting plugs have been removed.

Any engineering work on the moving walkway will involve running it on the remote switches and can therefore be detected.

The safety system monitors the brake release circuit ("BRAKE" & "B NEUTRAL) to determine operation of the moving walkway, although other methods could be employed.

If the walkway is running and the safety loop at the monitoring point is inactive, a memory device is set to indicate engineering intervention and the safety system disables further automatic operation of the moving walkway. In order to reset this memory device, the step sensors must detect a predetermined number of steps and confirm that there are no missing steps. For example, if the entire loop of steps comprises seventy-five (75) steps, the predetermined count should be at least 75, and preferably 100 or more, to ensure a satisfactory inspection run of the entire loop of steps has been completed. Driving of the loop of steps (so as to undertake the inspection run) is achieved using the manual remote switches as these bypass the missing step safety relay.

Once the required number of steps has passed the missing step sensors, the interrupt unit completes the safety loop to enable automatic operation of the moving walkway.

In an embodiment, the reset process may comprise the following steps:

- Remove the shorting plugs and connect the remote switch (es).
- Operate and work on the machine using the remote switches.
- Engineer intervention is detected by monitoring motor activity (e.g. "BRAKE" signal) while the safety loop is broken. At this point, a count is reset to disable automatic operation and the safety loop is broken.
- The engineer indicates to the safety system (typically by pressing a reset switch) that the safety loop is to be reinstated after the pre-determined number of steps has passed the missing step detector(s) without a missing step being detected. Automatic operation is reinstated once this count has been reached. If the power is interrupted, the machine is stopped or a missing step detected, this process must restart. Hence, this has to be one continuous uninterrupted operation.
- Once automatic operation is reinstated, the engineer stops the machine and replaces the shorting plugs. This will be seen by the safety system as a normal shutdown.

Automatic operation is now restored.

For an embodiment, the following installation notes may apply.

An embodiment monitors a moving walkway and checks for missing steps, obstructed or jammed handrails, or engineer intervention.

If either handrail sensor detects a slowed or jammed handrail, the safety loop will be interrupted to disable automatic operation of the machine. Operation can only be resumed by cycling the power (off then on).

If either step sensor detects a missing step, detects a step constantly, or detects no step constantly, the safety loop will be interrupted to disable automatic operation of the moving walkway. Automatic operation of the moving walkway can only then be resumed by performing a safety/checking procedure in accordance with an embodiment.

If the unit detects machine operation while the safety loop is interrupted, automatic operation will be disabled. Operation can only be resumed by performing a safety/checking procedure.

Installation

Mount the safety system within the control cabinet and connect according to the wiring diagram.

The POWER connections require 110-240 v AC (to be supplied via a 1 A-3 A fuse).

The BRAKE input can be derived from either the brake control contactor drive or the AC supply to the brake circuit. Note that the circuit requires an appropriate neutral connection. **

The LOOP connections allow for the interruption of the safety loop circuit and the monitoring of the safety loop circuit. The IN terminal should be connected downstream of the remote control connectors. The IN terminal is monitored when the BRAKE terminals are active to determine operation while a fault condition exists. This is taken to be engineering intervention. The OUT terminal now feeds the downstream circuit. The connection between IN and OUT is interrupted to disable the machine.

Note that the circuit also employs an appropriate neutral connection (The BRAKE circuit and the LOOP circuit may have separate (isolated) neutrals which must be connected appropriately. For example, the brake actuator circuit may be operated from an entirely separate 240 v supply having a separate neutral to the control circuitry).

The STEP sensors are connected as shown in FIG. 1. It does not matter which sensor is the top or bottom sensor. The sensors are positioned such that EVERY step is detected and EVERY gap is detected.

The RAIL sensors are connected as shown in FIG. 1. It does not matter which sensor is the left or right hand sensor. The sensors are positioned such that the pulse generating hole or bolt (it doesn't matter which) is detected every time it passes the sensor.

Setup

Once the safety system 100 is wired, check all connections before switching on. Once the wiring has been checked the safety system can be switched on. At this point the LOOP indicator 110 should be illuminated GREEN. The AUTO indicator 112 will be illuminated RED or GREEN dependent upon previous history. The BRAKE indicator 114 should not be illuminated.

Irrespective of whether or not the safety system 100 allows automatic operation, a calibration/engineering reset is to be performed first.

Remove the shorting plugs from the nearest remote socket and plug in the remote control.

Press and hold the RESET button 116 for approx. 5 seconds until the AUTO indicator 112 flashes RED (fast). Press and hold either the UP or DOWN jog button. The machine should start and the BRAKE indicator 114 should illuminate GREEN.

The sensor indicators 118 should flash to indicate the passing of steps and rotation of the handrail idler wheels.

The AUTO indicator 112 will flash RED (slow) as the unit determines the timing of the step sensors and handrail sensors. This is done while detecting the passage of (typically 32) steps. The safety system 100 now calculates the maximum time allowed for each step to pass and the maximum period for the gap between steps. It also calculates the maximum time between pulses from the handrail idler wheel sensors.

Once the unit has determined the correct timing, the AUTO indicator 112 will start to flash GREEN (slow). The safety system 100 will now check for valid signals for at least one complete cycle of the step loop (which may be in the region of 90 steps, for example). At the end of this check loop, the AUTO indicator will flash GREEN (fast).

The machine must now be turned off. The remote control must be removed and the shorting plugs plugged in.

The moving walkway is now ready for automatic operation.

If during operation a missing step is detected or a 'jammed' sensor is detected, the safety loop will be interrupted and the machine will stop. The AUTO indicator 112 will illuminate RED and the offending sensor 118 channel status indicator will now indicate RED. Automatic operation can then only be restored be performing an engineering reset (i.e. safety/checking procedure) as above. All error history (handrail) will be cleared and automatic operation only restored after a successful reset.

If, during operation, either handrail sensor pulse train slows down to below a predetermined rate, the safety loop will be interrupted and the machine will stop. The AUTO indicator 112 will illuminate RED and the offending sensor 118 channel status indicator will now indicate RED. Automatic operation can then only be resumed by cycling the power OFF and back ON. Automatic operation has been restored but the offending sensor 118 will now indicate the channel status in RED. This can only be cleared to GREEN by performing an engineering reset (i.e. safety/checking procedure) as above. The handrail monitoring may also be configured to require an engineering reset.

It will be appreciated that an embodiment may be retrospectively fitted into an existing escalator system or travelator system.

The reduced risk and liabilities associated with the system of the present invention enables the operators of conveyors to satisfy insurance companies that may not otherwise be willing to insure a conveyor should the safety system be disabled (or not installed).

Given the substantial investment that is associated with the installation and running of an moving walkway system, there is a significant advantage in being able to upgrade an existing moving walkway system. Embodiments of the invention may allow for a simple retrospective installation into an existing moving walkway system. This can reduce costs and upfront investment in new systems and avoid the removal of existing moving walkway systems that may still be in good working condition.

Other variations to the disclosed embodiments can be understood and effected by those skilled in the art in practicing the claimed invention, from a study of the drawings, the disclosure, and the appended claims. For example, in the examples above:

The safety system may comprise a processor and the functions of individual components may be carried out by the processor.

The safety system is not limited to a box-type device. It may instead comprise a circuit board or separate components, for example.

A missing step sensor may be a proximity sensor, a magnetic sensor or any other sensor that can detect the presence (or absence) of a step in a moving walkway system.

The invention claimed is:

1. A safety system for a moving walkway having a continuous loop of steps driven by a drive system and a missing step detector adapted to detect a missing step from the loop of steps, wherein the safety system comprises:

an interrupt unit adapted to control the drive system to disable automatic movement of the loop of steps upon detection of a predetermined event and adapted to subsequently control the drive system to enable automatic movement of the loop of steps only after a safety procedure has been completed without a missing step being detected by the missing step detector, wherein the safety procedure comprises causing a step to traverse an entire loop under manual control of the drive system.

2. The safety system of claim 1, wherein the predetermined event comprises at least one of: the missing step detector detecting a missing step from the loop of steps; an engineer accessing the moving walkway for maintenance or repair purposes; activation of an emergency stop control of the moving walkway; activation of a reset control of the moving walkway; and manual control of the drive system.

3. The safety system of claim 1, further adapted to monitor a signal derived from the missing step detector so as to determine the occurrence of the predetermined event.

4. The safety system of claim 1, further adapted to monitor a signal derived from a braking system of the moving walkway so as to determine the occurrence of the predetermined event.

5. The safety system of claim 1, further adapted to monitor a safety interlock loop of the safety system downstream of remote sockets of the safety system.

6. The safety system of claim 1, wherein the interrupt unit is adapted to determine the safety procedure has been completed by checking if a predetermined number of steps has passed a fixed point in the loop without a missing step being detected, wherein the pre-determined number of steps is greater than or equal to the number of steps in the entire loop of steps.

7. The safety system of claim 1, wherein the safety system is adapted to be retrospectively connected to a moving walkway.

8. A moving walkway comprising the safety system of claim 1.

9. The moving walkway of claim 8, wherein the moving walkway comprises an escalator.

10. The moving walkway of claim 8, wherein the moving walkway comprises a travelator.

11. A method of controlling a moving walkway having a continuous loop of steps driven by a drive system and a missing step detector adapted to detect a missing step from the loop of steps, wherein method comprises:

controlling the drive system to disable automatic movement of the loop of steps upon detection of a predetermined event;

causing a step to traverse an entire loop under manual control of the drive system; and subsequently controlling the drive system to enable automatic movement of the loop of steps only if the preceding action of causing a step to traverse an entire loop under manual control of the drive system was completed without a missing step being detected by the missing step detector.

12. The method of claim 11, wherein the predetermined event comprises at least one of: the missing step detector detecting a missing step from the loop of steps; an engineer accessing the moving walkway for maintenance or repair purposes; activation of an emergency stop control of the moving walkway; activation of a reset control of the moving walkway; and manual control of the drive system.

13. The method of claim 11, comprising monitoring a signal derived from the missing step detector so as to detect the predetermined event.

14. The method of claim 11, comprising monitoring a signal derived from a braking system of the moving walkway so as to detect the predetermined event.

15. The method of claim 11, further comprising monitoring a safety interlock loop of the walkway system downstream of remote sockets of the walkway system.

16. The method of claim 11, further comprising determining if causing a step to traverse an entire loop under manual control of the drive system was completed without a missing step being detected by the missing step detector by checking if a predetermined number of steps has passed a fixed point in the loop without a missing step being detected, wherein the pre-determined number of steps is greater than or equal to the number of steps in the entire loop of steps.

* * * * *